US011185962B1

(12) United States Patent
Kirk

(10) Patent No.: US 11,185,962 B1
(45) Date of Patent: Nov. 30, 2021

(54) TORQUE IMPARTING DEVICE

(71) Applicant: Kevin Kirk, Garfield, NJ (US)

(72) Inventor: Kevin Kirk, Garfield, NJ (US)

( * ) Notice: Subject to any disclaimer, the term of this patent is extended or adjusted under 35 U.S.C. 154(b) by 0 days.

(21) Appl. No.: 17/301,302

(22) Filed: Mar. 31, 2021

(51) Int. Cl.
*B25B 13/46* (2006.01)
*B25B 13/50* (2006.01)

(52) U.S. Cl.
CPC ..... *B25B 13/463* (2013.01); *B25B 13/505* (2013.01)

(58) Field of Classification Search
CPC ..... B25B 13/463; B25B 13/505
USPC ..... 81/64, 65.2, 69
See application file for complete search history.

(56) References Cited

U.S. PATENT DOCUMENTS 1,314,964 A * 9/1919 Kennedy ..... B25B 13/463 81/63
1,709,378 A 4/1929 Sulger
2,361,769 A 10/1944 Hollingsworth
2,612,808 A 10/1952 Small
2,656,750 A 10/1953 Rasco
2,757,564 A * 8/1956 Reaves ..... B25B 13/463 81/58.2
3,661,041 A 5/1972 Welz
3,752,016 A 8/1973 Ballard
4,258,595 A * 3/1981 Ramsey ..... B25B 13/463 81/61
4,441,387 A 4/1984 Hendricks
4,797,965 A 1/1989 Mazzone
4,989,479 A 2/1991 Anderson et al.
5,131,300 A 7/1992 Daniel
6,263,765 B1 7/2001 McCamley
6,450,068 B1 9/2002 Hu
6,948,351 B2 9/2005 Norin
7,249,539 B2 7/2007 Decaprio
7,913,589 B2 3/2011 Chen
8,479,618 B2 7/2013 Hsiao
9,370,857 B2 6/2016 Guenther et al.
2005/0028649 A1 2/2005 Settanni
2010/0282032 A1 11/2010 Brailey
2011/0113935 A1 5/2011 Hall
2014/0033880 A1 2/2014 Hill
2014/0076110 A1 3/2014 Schunke
2015/0360350 A1 12/2015 Jiang
2017/0072542 A1* 3/2017 Eldessouky ..... B25B 13/463
2018/0326559 A1 11/2018 Lai

* cited by examiner

*Primary Examiner* — Hadi Shakeri
(74) *Attorney, Agent, or Firm* — Dunlap Bennett & Ludwig, PLLC

(57) ABSTRACT

A torquing tool having an apertured head supporting a perimetral toothed surface closable about a rotary object in a self-fitting/clamping manner, wherein the aperture head provides a ratchet enable pawl operatively associable with the perimetral toothed surface.

5 Claims, 4 Drawing Sheets

TORQUE IMPARTING DEVICE

BACKGROUND OF THE INVENTION

The present invention relates to wrenches and, more particularly, a torque imparting device having an apertured head supporting a perimetral toothed surface closable about a rotary object in a self-fitting/clamping manner, wherein the aperture head provides a ratchet enable pawl operatively associable with the perimetral toothed surface.

A wrench is a tool used to provide grip and mechanical advantage in applying torque to turn objects—usually rotary fasteners, such as nuts and bolts—or keep them from turning.

Current wrenches require, however, the user to calibrate and adjust the wrench's movable jaw to provide a proper fit with the rotary object. Or for a ratchet setup, the user needs to find the correct size head that properly fits the rotary object. Furthermore, after a rotating the wrench a certain angular distance or displacement, the user must pull off the wrench's jaw, regain the proper fit to said object, apply torque again, and repeat until the object has been sufficiently rotated.

The time to confirm a proper fit and/or pull off repeatedly can be substantial, especially when having to apply the wrench to multiple objects, which is not uncommon.

As can be seen, there is a need for a torquing tool having an apertured head supporting a perimetral toothed surface closable completely around a rotary object in a self-fitting manner, obviating the time and effort to calibrate and facilitated a proper fit. The self-clamping/self-fitting manner embodied in the perimetral toothed surface closable entirely around a rotary object enables a plurality gripping surfaces of the perimetral toothed surface to essentially attach/clamp themselves to the rotary object, which saves time and effort relative to the prior art. Furthermore, the aperture head may provide a finger-actuated pawl operatively associable with the perimetral toothed surface, enabling a ratchet-effect so that the torquing tool need not be disengaged from the rotary object until the user decides the task is done.

SUMMARY OF THE INVENTION

In one aspect of the present invention, a torque-imparting device includes the following: an apertured head movable between an open position and a closed position defining an aperture; a perimetral toothed ring operatively associated along an inner periphery of the aperture; and a pawl connected to the apertured head in such a way as to enable the apertured head to impart rotational drive to the perimetral toothed ring.

In another aspect of the present invention, the imparting device further includes wherein the apertured head comprising a first head portion connected to a second head portion in such a way that the second head portion moves between the open position and the closed position, wherein the first and second head portions each have complemental grooves in which a root portion of the perimetral toothed ring slides, wherein the perimetral toothed ring comprising a plurality of jigsaw teeth, wherein each jigsaw tooth of the plurality of jigsaw teeth provides a male portion and a female portion in a locked engagement with the female portion and the male portion of at least one adjacent jigsaw tooth of the plurality of the jigsaw teeth; including a telescoping joint defining an axis of rotation about which the second head portion moves between the open position and the closed position, wherein the telescoping joint moves between an extended condition and a nested condition in a direction parallel to the axis of rotation, wherein the extended condition at least two of the plurality of jigsaw teeth in an unlocked engagement with an adjacent jigsaw tooth of the plurality of the jigsaw teeth; and a latching opening is provided in an outer perimetral edge of each jigsaw tooth, wherein a latching portion of the pawl selectively forms an enmeshed engagement with the latching opening to enable the apertured head to impart rotational drive to the perimetral toothed ring; a gripping portion of each jigsaw teeth radially protrudes toward a center of the aperture for self-fitting the perimetral toothed ring to a rotary object circumscribed in the aperture with the apertured head in in the closed position; and a handle connected to the first head portion.

These and other features, aspects and advantages of the present invention will become better understood with reference to the following drawings, description and claims

DETAILED DESCRIPTION OF THE INVENTION

Figure 1:
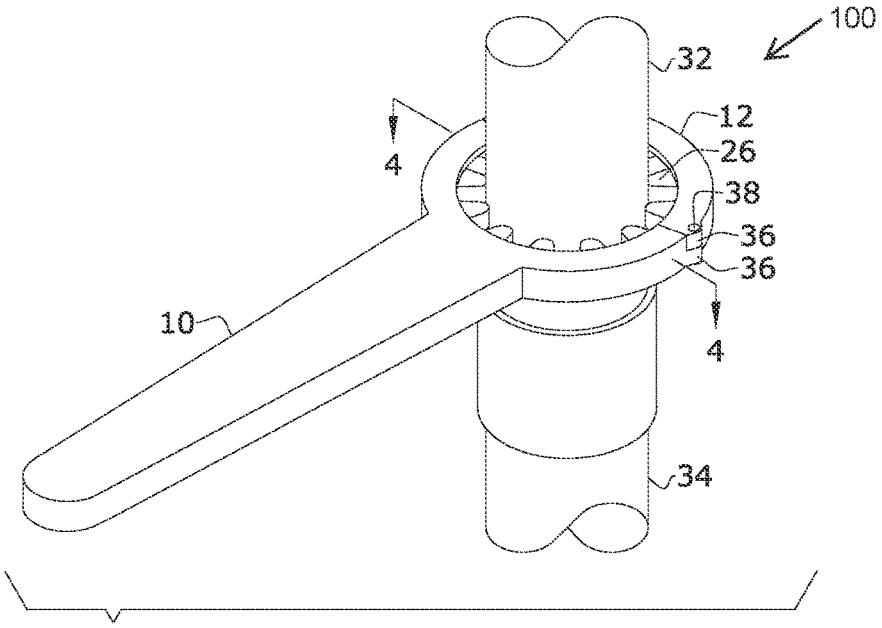
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a torquing tool having an apertured head supporting a perimetral toothed surface closable entirely around a rotary object in a self-fitting/clamping manner, wherein the aperture head provides a ratchet-enabling pawl operatively associable with the perimetral toothed surface.

Referring now to FIGS. 1 through 8, the present invention may include a torquing tool 100. The torquing tool 100 has a handle 10 having a first head portion 11 of an apertured head 13. A second head portion 12 of the apertured head 13 is pivotable attached to the first head portion 11 so that the second head portion 12 moves between an open position and a closed position defining the aperture head 13 as a closed loop. The pivotable attachment may be by way of a telescoping pivotable connector 50 through a pivot point 36. The pivot point 36 may be a pair of knuckles, hinge ears, or the like, wherein each of the pair of pivot points 36 are connected to the first head and second head portion 11 and 12, respectively.

The telescoping pivotable connector 50 may include a base joint 42 and a telescopically associated middle joint 40 operably associable in such a way to be movable between a nested condition and an extended condition wherein the middle joint 40 substantially protrudes from the base joint 42. The middle joint 40 may be dimensioned and adapted to receive an end joint 38. The base joint 42 and the end joint 38 may each have a flange portion that engages the pair of pivot points 36, respectively.

The first head and second head portions 11 and 12 each define a complemental groove 30 along their respective inner circumferences. The complemental grooves 30 are dimensioned and adapted to receive a plurality of interconnectable jigsaw teeth 20 defining a perimetral toothed surface. Conceptually, the groove/head portions are the 'gums' that support the 'roots' of the jigsaw teeth 20 that having 'crowns' extending radially inward. Each jigsaw tooth 20 'root' has a male tab 22 and an opposing female tab opening 24, the male tabs 22 and female tab openings 24 are oriented generally perpendicular to a longitudinal axis of the 'crown', though someway oblique to accommodate the circumferential nature of the complemental grooves 30. The 'crown' is the gripping surface 26 of each jigsaw tooth 20. The gripping surface 26 may have an arcuate convex shape or other geometrical shapes, such as non-arcuate concave teeth or the like as long as the gripping surfaces 26 function in accordance with the disclosure herein.

Figure 7:
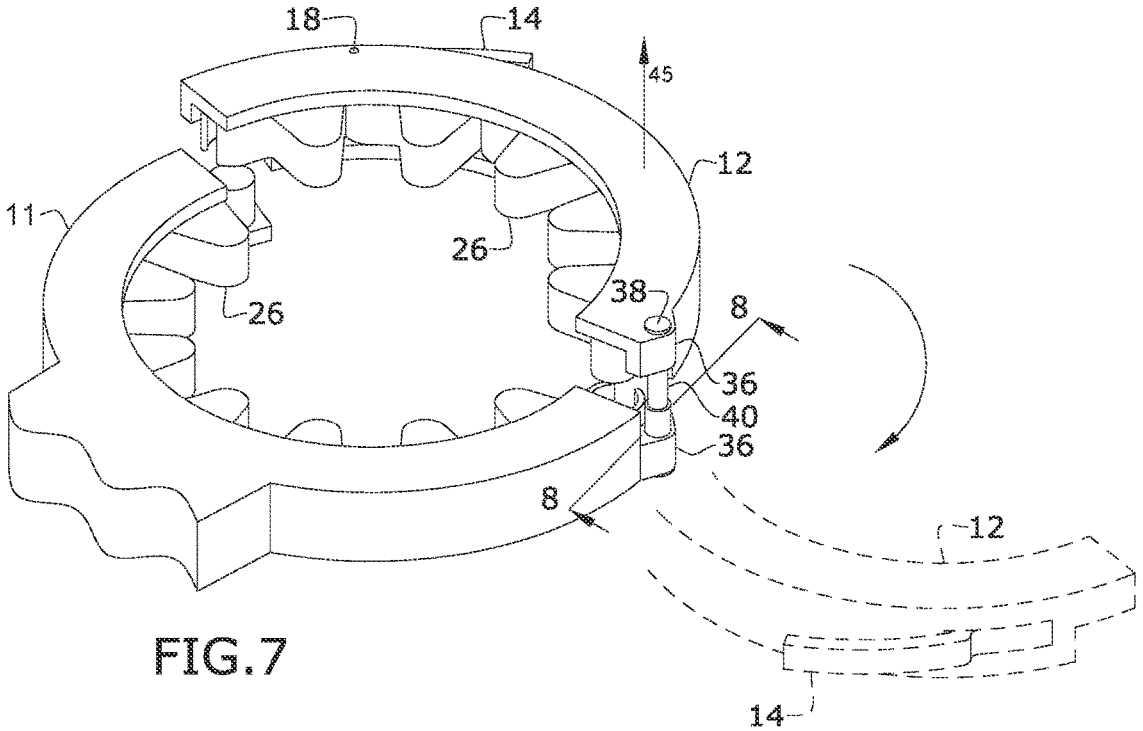
FIG. 7 is a perspective view of an exemplary embodiment of the present invention, showing the telescoping joint movable between a nested condition and an extended condition.
Figure 8:
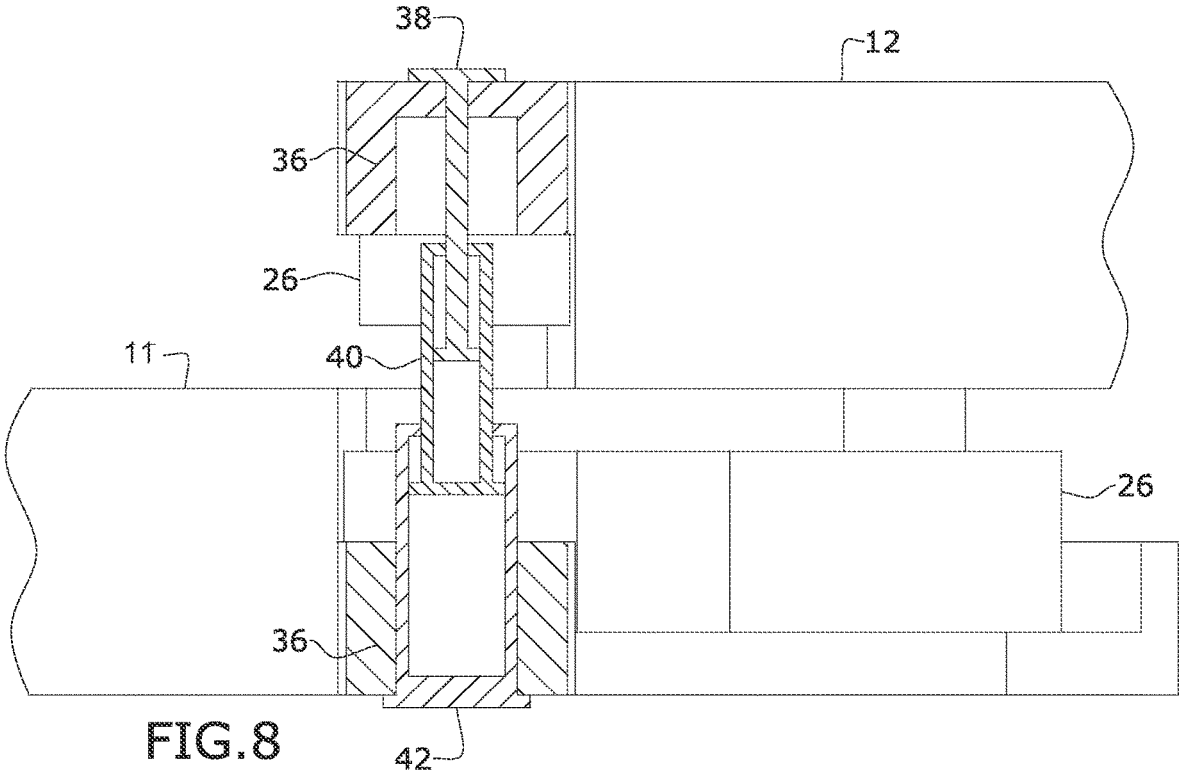
FIG. 8 is a section view of an exemplary embodiment of the present invention, take along line 8-8 in FIG. 7.

The male tabs 22 and female tab openings 24 are dimensioned and adapted to fit into each other in a direction normal to the aperture of the aperture head, as indicated by arrow 45 in FIG. 7. Accordingly, when the male tabs 22 and female tab openings 24 of adjacent jigsaw teeth 20 are in the nested condition, the adjacent jigsaw teeth 20 are interlocked, and similarly when one of two adjacent jigsaw teeth 20 are in the extended condition and the other the nested condition, said two adjacent jigsaw teeth 20 are unlocked.

Figure 5:
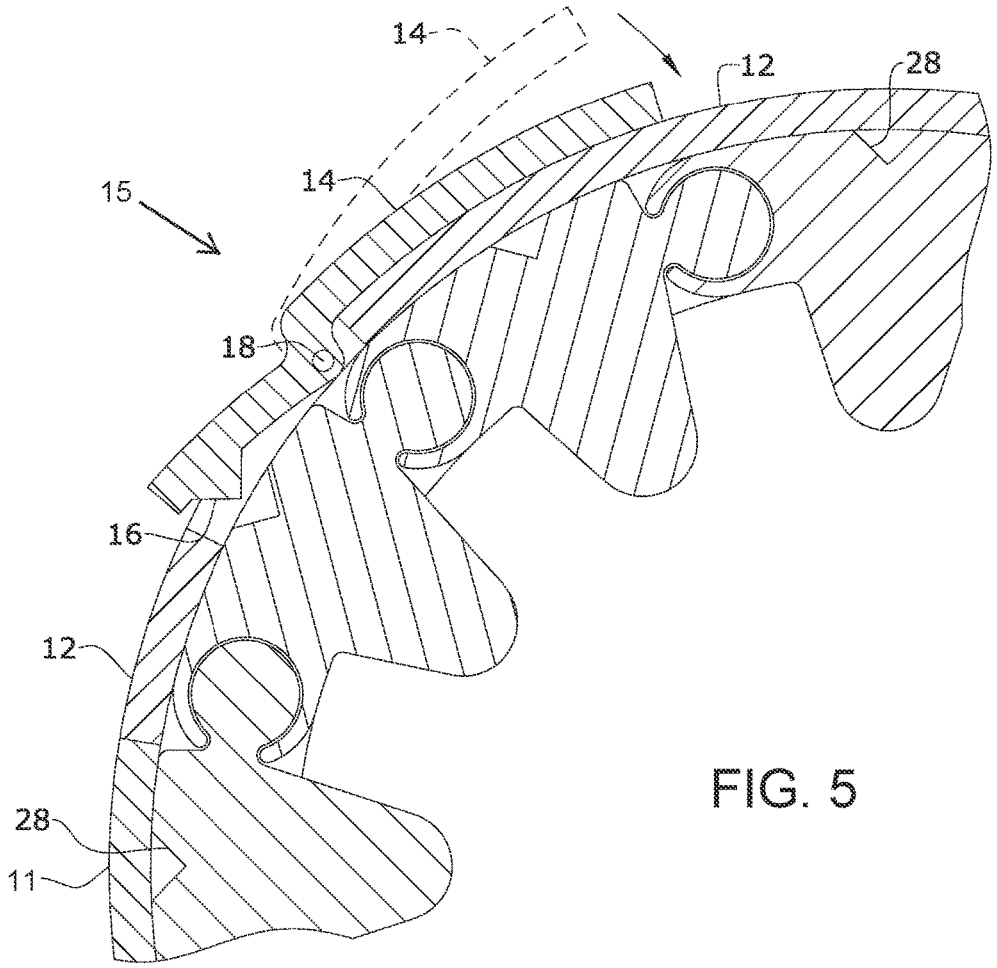
FIG. 5 is a detailed section view of FIG. 4, illustrating movement of the pawl 15 between an unmeshed engagement and a meshed engagement.
Figure 6:
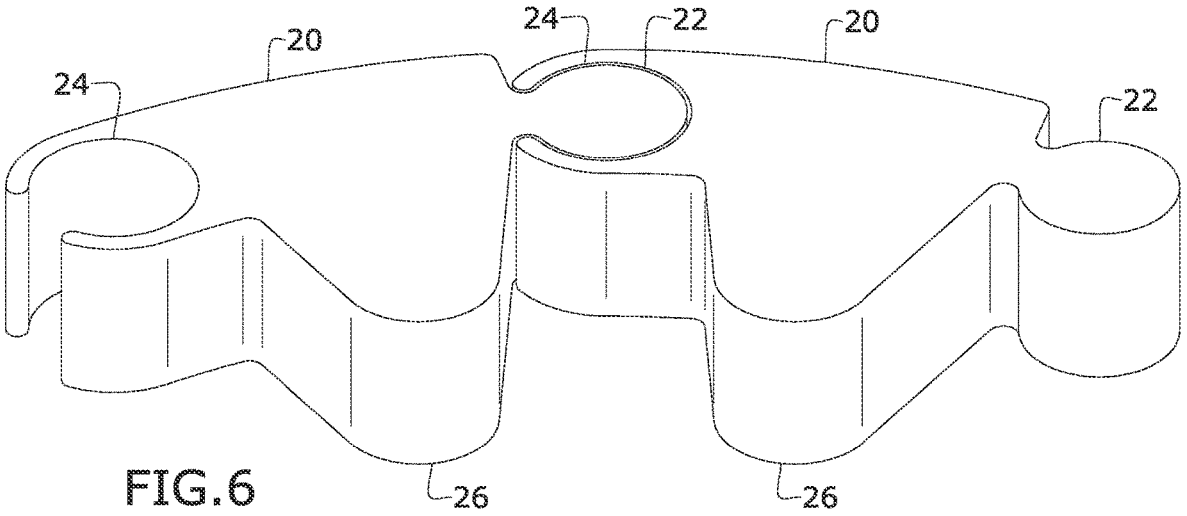
FIG. 6 is a detailed perspective view of an exemplary embodiment of interlocked jigsaw teeth of the present invention.

The outer perimetral edge or outer circumferential edge of each jigsaw tooth 20 has a latch opening 28. The second head portion 12 provides a pawl 15 with a finger-actuating lever 14 pivotable about a pivot pin 18 between an unmeshed engagement and an enmeshed engagement wherein a latching portion 16 of the pawl 15 engages one of the latch opening 28, as illustrated in FIG. 5. The second head portion 12 provides an opening for the latching portion 16 to slide through. In the unmeshed engagement, the plurality of jigsaw teeth 20 can slide along the groove 30 in either direction, while in the meshed engagement the plurality of jigsaw teeth 20/perimetral toothed surface are dependent in one rotational direction and independent in the opposite rotational direction, thereby enabling a ratchet effect when manipulating the handle 10.

Figure 2:
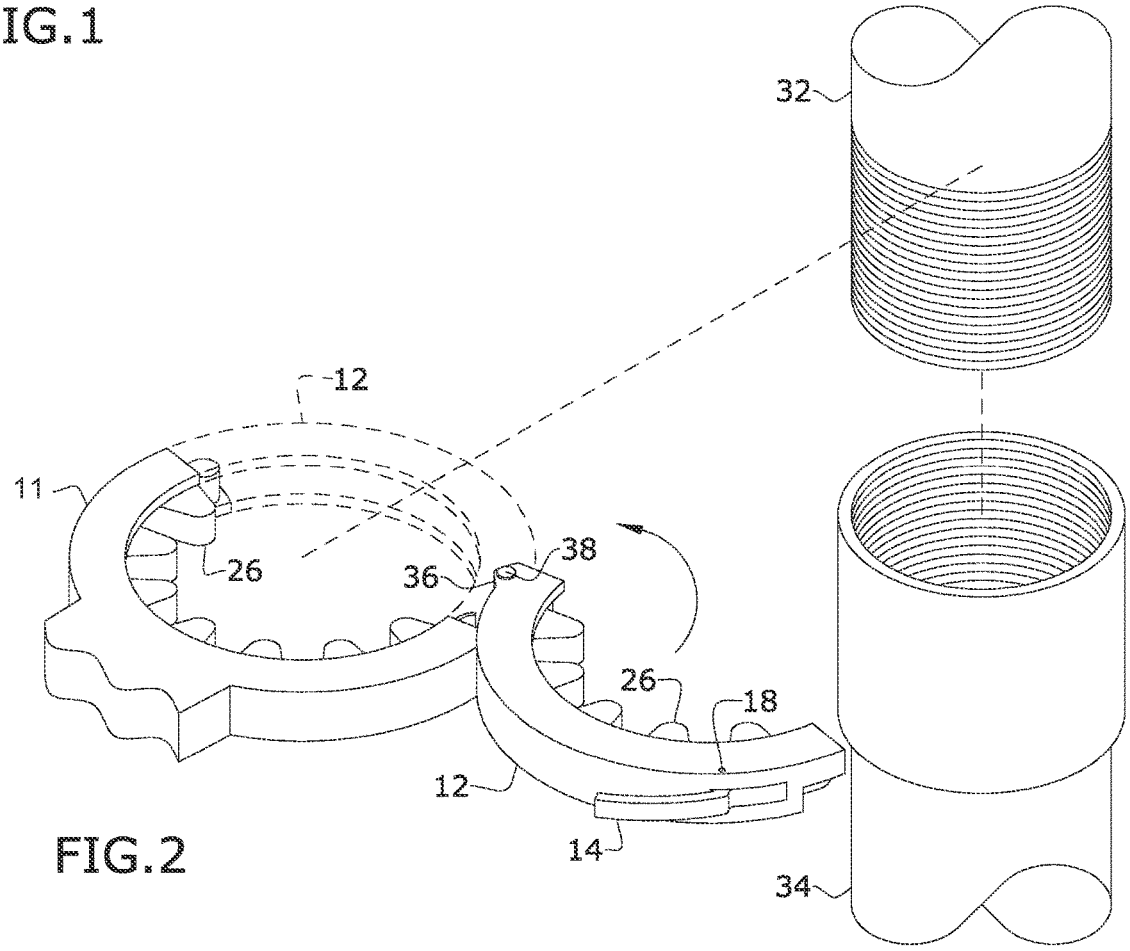
FIG. 2 is an exploded perspective view of an exemplary embodiment of the present invention, illustrating moving a second head portion from an open position to a closed position, while the second head portion is in an extended condition.
Figure 3:
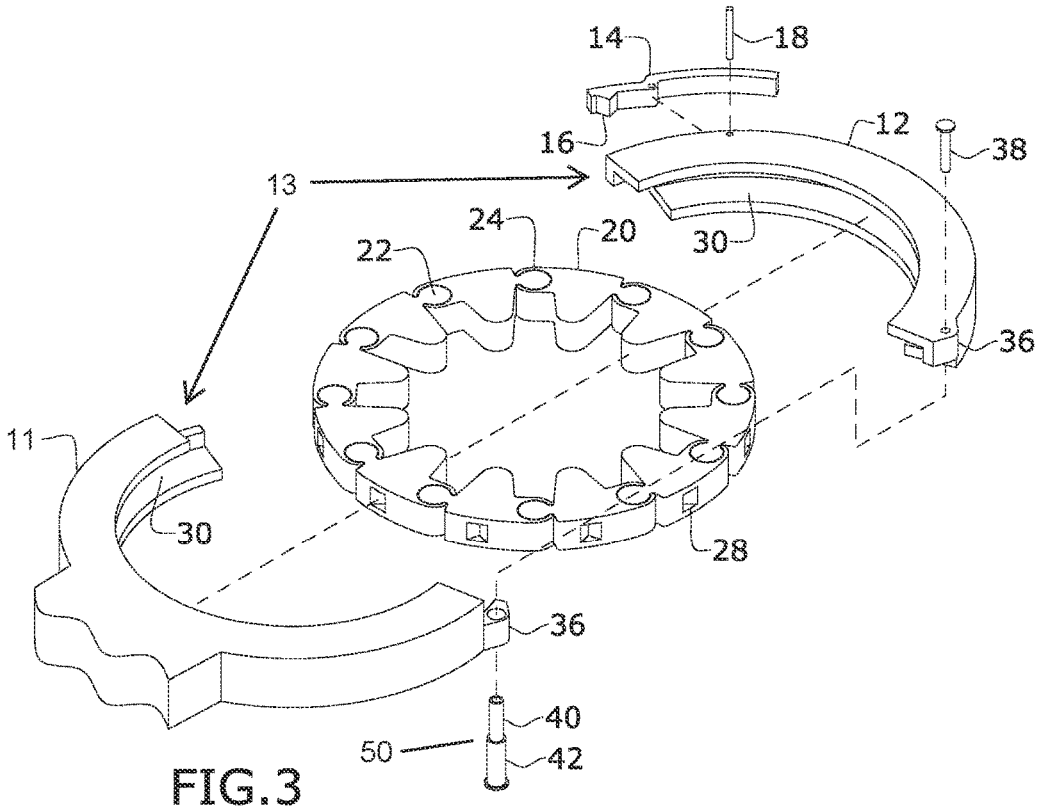
FIG. 3 is an exploded perspective view of an exemplary embodiment of the present invention.
Figure 4:
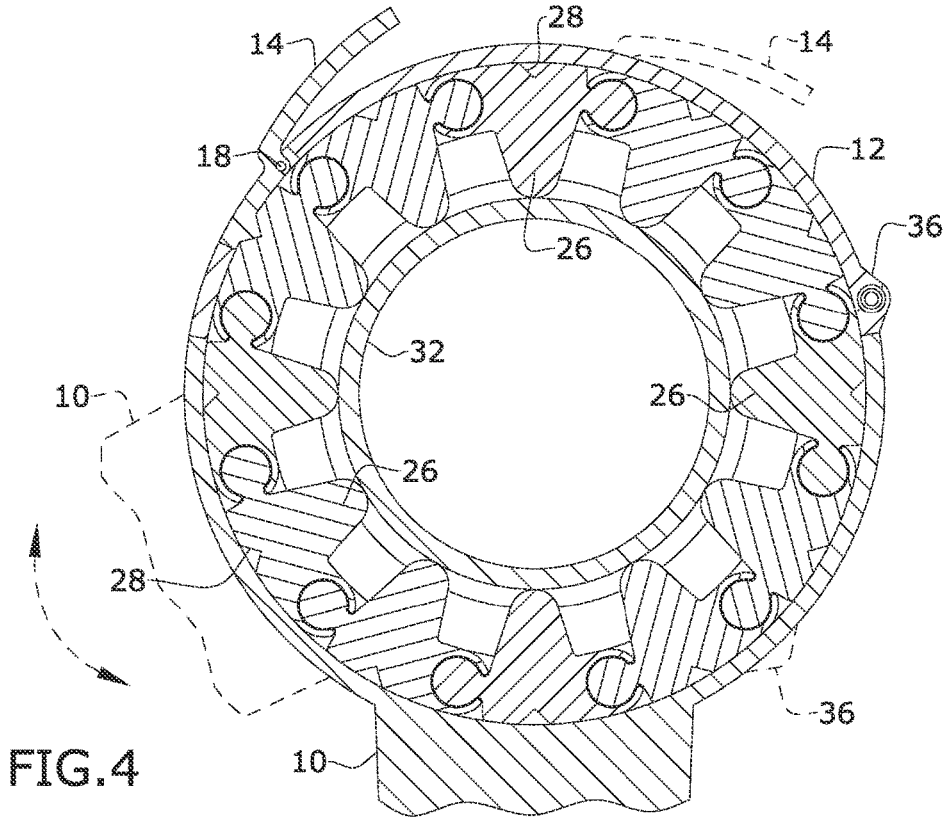
FIG. 4 is a section view of an exemplary embodiment of the present invention, take along line 4-4 in FIG. 1, illustrating a ratchet effect through rotation of the apertured head relative to the plurality of jigsaw teeth/perimetral toothed surface in a meshed engagement.

A method of using the present invention may include the following. The torquing tool 100 disclosed above may be provided. In the open position, a male object 32 may be circumscribed by moving the aperture head 13 to the closed position, as illustrated in FIG. 2, wherein the distal ends of the gripping surfaces 26 clamp to the perimeter of the male object 32. Then the second head portion 12 may be moved from the extended condition to the nested condition so that plurality of jigsaw teeth 20 define a coplanar perimetral toothed surface clamping to the perimeter of the male object 32. Then the pawl 15 may be pivoted to the meshed engagement with the latch opening 28 that further enables the clamped engagement of the plurality of gripping surfaces 26/perimetral tooted surface to the perimeter of the male object 32. Then the user may apply mechanically advantageous torque through the handle 10 so that the male object 32 moves relative to the female object 34 in a first rotational direction and then ratchet back the torquing tool 100 in the second rotational direction (opposite the first rotational direction). As an initial condition, the user may choose the first direction of the angular displacement of the male object 32 by flipping the torquing tool 100 appropriately, being mindful that the second direction facilitates the ratcheting effect.

The torquing tool could be operatively associated with an automatic system such as a robot or another device.

It should be understood, of course, that the foregoing relates to exemplary embodiments of the invention and that modifications may be made without departing from the spirit and scope of the invention as set forth in the following claims.

What is claimed is:

1. A torque-imparting device, comprising:

an apertured head movable between an open position and a closed position defining an aperture;

a perimetral toothed ring operatively associated along an inner periphery of the aperture;

a pawl connected to the apertured head in such a way as to enable the apertured head to impart rotational drive to the perimetral toothed ring, wherein the apertured head comprising a first head portion connected to a second head portion in such a way that the second head portion moves between the open position and the closed position, wherein the first and second head portions each have complemental grooves in which a root portion of the perimetral toothed ring slides, wherein the perimetral toothed ring comprising a plurality of jigsaw teeth, wherein each jigsaw tooth of the plurality of jigsaw teeth provides a male portion and a female portion in a locked engagement with the female portion and the male portion of at least one adjacent jigsaw tooth of the plurality of the jigsaw teeth; and a telescoping joint defining an axis of rotation about which the second head portion moves between the open position and the closed position, wherein the telescoping joint moves between an extended condition and a nested condition in a direction parallel to the axis of rotation.

2. The torque-imparting device of claim 1, wherein the extended condition at least two of the plurality of jigsaw teeth in an unlocked engagement with an adjacent jigsaw tooth of the plurality of the jigsaw teeth.

3. The torque-imparting device of claim 2, further comprising:

a latching opening is provided in an outer perimetral edge of each jigsaw tooth, wherein a latching portion of the pawl selectively forms an enmeshed engagement with the latching opening to enable the apertured head to impart rotational drive to the perimetral toothed ring.

4. The torque-imparting device of claim 3, further comprising:

a gripping portion of each jigsaw teeth radially protrudes toward a center of the aperture for self-fitting the perimetral toothed ring to a rotary object circumscribed in the aperture with the apertured head in in the closed position.

5. The torque-imparting device of claim 4, further comprising a handle connected to the first head portion.

* * * * *